US007246960B2

(12) United States Patent
Kohyama et al.

(10) Patent No.: US 7,246,960 B2
(45) Date of Patent: Jul. 24, 2007

(54) PRINT HEAD

(75) Inventors: Takuro Kohyama, Nishitokyo (JP); Kazumi Hasegawa, Tachikawa (JP); Yasuo Iwata, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 182 days.

(21) Appl. No.: 10/543,401

(22) PCT Filed: Feb. 10, 2004

(86) PCT No.: PCT/JP2004/001379

§ 371 (c)(1),
(2), (4) Date: Jul. 26, 2005

(87) PCT Pub. No.: WO2004/069546

PCT Pub. Date: Aug. 19, 2004

(65) Prior Publication Data

US 2006/0147238 A1 Jul. 6, 2006

(30) Foreign Application Priority Data

Feb. 10, 2003 (JP) ..... 2003-032792

(51) Int. Cl.
*B41J 2/22* (2006.01)
*B41J 2/275* (2006.01)

(52) U.S. Cl. ..... 400/124.01; 400/124.2; 400/124.11; 400/124.17; 400/124.23

(58) Field of Classification Search ..... 400/26, 400/124.01, 124.23, 124.11, 124.17, 124.2
See application file for complete search history.

(56) References Cited

U.S. PATENT DOCUMENTS 5,540,508 A * 7/1996 Asada et al. ..... 400/124.12

FOREIGN PATENT DOCUMENTS

EP 0146001 6/1985
JP 61-8794 1/1980
JP 57-174275 10/1982
JP 60-262667 12/1985
JP 03-190751 8/1991
JP 05-024213 2/1993

(Continued)

OTHER PUBLICATIONS

Microfilm of specification (pp. 289-300) and drawings (pp. 301-303) annexed to Japanese Utility Model Application No. 072257/1988 (Laid-open No. 175823/1989), Toshiba Corp., Dec. 14, 1989.

(Continued)

*Primary Examiner*—Daniel J. Colilla
*Assistant Examiner*—Marissa Ferguson-Samreth
(74) *Attorney, Agent, or Firm*—Smith, Gambrell & Russell, LLP

(57) ABSTRACT

A needle guide (5) is composed of a first guide wall (5*a*) and a second guide wall (5*b*) arranged at a distance x from each other. Each of these guide walls is formed with through holes through which needles penetrate and which extends parallel to the longitudinal direction of a needle bunch, the through holes of the first guide wall and the second guide wall for one needle is shifted from each other in the convergence direction of the needles with a shift amount δn determined by the distance x and a convergence angle θn of the needle.

6 Claims, 6 Drawing Sheets

FOREIGN PATENT DOCUMENTS

| | | |
|---|---|---|
| JP | 5-330090 | 12/1993 |
| JP | 2582809 | 7/1998 |

OTHER PUBLICATIONS

Microfilm of specification (pp. 524-528) and drawings (pp. 529-530) annexed to Japanese Utility Model Application No. 074715/1989 (Laid-open No. 016244/1992), Seiko Epson Corp., Feb. 19, 1991.

Microfilm of specification (pp. 505-513) and drawings (pp. 514-516) annexed to Japanese Utility Model Application No. 045553/1988 (Laid-open No. 153940/1989), Shinko Seisakusho Co., Ltd., Oct. 24, 1989.

Microfilm of specification (pp. 380-386) and drawings (pp. 387-388) annexed to Japanese Utility Model Application No. 122872/1984 (Laid-open No. 037937/1986), Alps Electric Co., Ltd., Mar. 10, 1986.

Microfilm of specification (pp. 352-358) and drawings (pp. 359-360) annexed to Japanese Utility Model Application No. 004608/1982 (Laid-open No. 107840/1983), Oki Electric Industry Co., Ltd., Jul. 22, 1983.

* cited by examiner

PRINT HEAD

TECHNICAL FIELD

The present invention relates to a print head of a dot printer.

BACKGROUND ART

A print head (FIGS. 1A, 1B, 1C and 1D) of a dot printer comprises a plurality of needles 1 (1-1 to 1-9 as illustrated), and uses a drive unit such as a solenoid to project necessary needles 1-n selectively for printing, thereby forming dots on a paper 2 to print it.

A plurality of needles 1 have their respective proximal ends on the drive side arranged on a circumference C and are converged so that their tip ends for forming dots are arranged straight in a dotting position p, thus forming a cone-shaped needle bunch 3 (FIG. 1A). This needle bunch is kept in the cone-shaped configuration by an intermediate needle guide 4 located halfway in its longitudinal direction and a tip needle guide 5 at its tip end portion. In some cases, there may exist a plurality of intermediate needle guides 4.

Since a clearance d is defined between the tip needle guide 5 and a surface of the paper 2 (FIG. 1B), needle holes in the tip needle guide 5 are not arranged straight in this region but are apparently arranged in zigzag (FIG. 1D). Further, an angle between each needle 1 that constitutes the cone-shaped needle bunch 3 and a horizontal plane HP (plane perpendicular to the surface of the paper 2) will be referred to as a convergence angle (θn), and a direction from the proximal end of the needle 1 toward the tip end, as viewed from the front (viewed from the bottom of the cone of the needle guide toward its vertex), as a convergence direction (FIG. 2A). The intermediate needle guide and the tip needle guide will be referred to simply as a needle guide, in general.

The structure for guiding the needles 1 in the print head of the dot printer is essential to the maintenance of the accuracy of printing. The construction and material of the needle guide itself and a structure for its attachment to a head body have been repeatedly improved in various manners.

In a print head described in Japanese Utility Model Application Registered No. 2582809, for example, a plurality of intermediate needle guides are constructed separately, and the intermediate needle guides are arranged for movement with respect to a nose (head body) in the axial direction of the needles. Thus, the needles are prevented from being partially distributed when all the needles are set. In a tip wire bearing structure described in Japanese Patent Application Examined No. 61-8794, moreover, a hollow bearing structure is constructed having a front wall and a rear wall, and it is penetrated by the respective tip end portions of print wires in a direction perpendicular to the opposite walls.

For miniaturization and reduction in weight, conventional print heads are designed so that the guide wall thickness of the needle guide is thinned, and are formed of synthetic resin or other materials that are low-priced and light in weight. However, a print head of a dot printer requires durability such that the needles 1 can reciprocate about one hundred million times, and the needle guide naturally requires equal durability. On the other hand, the synthetic resin easily wears, and the guide wall thickness should be increased in some measure. Besides, it costs high to form through holes for the needles 1 in a direction such that the needles 1 are inclined as they penetrate the holes.

More specifically, the needles 1 of the needle bunch 3 have their respective different convergence angles (θn), and it is very hard to form slanting holes adapted to their respective convergence angles, in guide walls. Even if those holes can be formed, it is difficult to locate the needle guide in an accurate position in a body case when the needles 1 are passed and incorporated into the head body. Some of the needles 1 suffer "rubbing" between a plurality of needle guides, and a load on the needles becomes too heavy for high-accuracy printing.

Normally, therefore, the through holes for the needles 1 are simply formed in a direction perpendicular to the obverse and reverse surfaces of the guide walls, while the intermediate needle guides are mounted for movement in the longitudinal direction toward the head body. In this case, the needles 1 have the convergence angles (θn) for the through holes, so that the through holes should be lengthened in the convergence direction of the needles, depending on the guide wall thickness. Thereupon, if the guide wall thickness is increased to improve the durability of the needle guide, the length of the through holes in the convergence direction increases correspondingly, so that the operation of the needles 1 becomes unstable. Further, the durability fails to be improved despite the increase of the wall thickness.

This tendency is further enhanced if the inclination (convergence angle) of the needles is increased to reduce the longitudinal length of the print head. Thus, since the convergence angle of the needles is widened, the length of the needle holes in the convergence direction further increases, so that the through holes are enlarged (FIG. 2B).

The bearing structure described in Japanese Patent Application Examined No. 61-8794 is the hollow structure having the front wall and the rear wall. However, the print wires are passed through both the walls at right angles to them, and the wires have no angles equivalent to the convergence angles (θn) in the position of the bearing structure. Although this bearing structure has the first wall and the rear wall separate from each other, the same effect can be obtained when the longitudinal thickness is increased.

The tip needle guide suffers another problem that is aroused when the convergence angle (θn) varies. More specifically, the through holes of the needles 1 are inevitably enlarged, so that a plurality of through holes are located too close to each other to secure necessary spaces for molding, and some of the through holes communicate with each other (FIG. 2C). If this is done, the strength of the needle guide itself lowers. Further, projections at the junctions easily wear, and the through holes inevitably communicate with each other, so that guiding the tip end portions of the needles tends to be unstable. Thus, high-accuracy printing cannot be enjoyed with ease.

DISCLOSURE OF THE INVENTION

The object of the present invention is to provide a print head enjoying high durability and provided with needle guides capable of steadily guiding needles 1.

This invention may be applied to an intermediate needle guide only, to both the intermediate needle guide and a tip needle guide, or to the tip needle guide only.

The present invention relates to a print head for selectively projecting a plurality of needles to perform printing. The respective proximal ends of the plurality of needles on the drive side are arranged on the circumference of a circle, so that the needles constitute a cone-shaped needle bunch converged in a manner such that tip ends for forming dots are arranged straight in a dotting position. The needle bunch is kept in the cone-shaped configuration by a needle guide.

The needle guide is composed of a first guide wall and a second guide wall. The first guide wall and the second guide wall are arranged at a distance (x) from each other in the longitudinal direction of the needle bunch.

Further, the first guide wall and the second guide wall are walls perpendicular to the longitudinal direction of the needle and are formed into an integral block.

The first guide wall and the second guide wall are formed individually with through holes which the needles penetrate in a direction parallel to the longitudinal direction of the needle bunch, that is, in a direction perpendicular to the surfaces of the guide walls.

The through holes in the first guide wall and the second guide wall for one needle (No. n) are shifted from each other in the convergence direction of the needles by a shift amount ($\delta n$) determined by the distance (x) and the convergence angle ($\theta n$) of the needle.

The needle guide is composed of the first guide wall and the second guide wall that are kept at the distance (x), and they are formed into the integral block. This produces the same effect that can be obtained when the guide walls are thickened, and the structure is made sturdier. Two needle guides are joined together into a block, so that the number of components used and manufacturing labor can be reduced.

Since the through holes in the first guide wall and the second guide wall extend parallel to the longitudinal direction of the needle bunch, moreover, products can be manufactured at low cost with conventional techniques. Further, the through holes in the first guide wall and the second guide wall for one needle (No. n) are shifted from each other in the convergence direction of the needles by the shift amount ($\delta n$) determined by the distance (x) and the convergence angle ($\theta n$) of the needle. The needle guide wall composed of a first guide wall and a second guide wall has the same function as a needle guide wall composed of a single wall having a corresponding thickness, but does not suffer any effect (through hole size, etc.) resulting from increasing the thickness of a needle guide wall composed of a single wall. In consequence, the needle guide can avoid being embrittled by the increase of the through holes in size.

In the tip needle guide, a distance (y) from the dotting position p to the second guide wall sometimes may be adjusted to a minimum selectable value as far as the thickness of a partition wall between vertically adjoining through holes in the second guide wall is not smaller than the allowable thickness (a) of a partition wall between adjoining through holes in a guide wall of a material from which the tip needle guide is made.

The dotting position p is settled when the print head is designed, and the distance y from the dotting point p to the second guide wall corresponds to a value ($y=x+d$) that is obtained by adding a clearance d between the first guide wall and a paper to the distance (x) between the first guide wall and the second guide wall.

If the material of the tip needle guide is synthetic resin, such as nylon, for example, the thickness (a) of the partition wall between through holes in the guide wall is adjusted to 40 μm. If the designed thickness is less than this value, the through holes inevitably communicate with each other during molding operation, so that the function to guide the needles and the durability are insecure. To avoid this, it is necessary only that the second guide wall be located in a position distant enough from the first guide wall. However, this is incompatible with miniaturization of a print head. Thereupon, the distance (y) from the dotting position p to the second guide wall is adjusted to a value such that the partition wall between the vertically adjoining through holes has a minimum dimension (depending on the material) when the through holes are formed independently of one another in the second guide wall.

With this arrangement, although the through holes of the first guide wall of the tip needle guide inevitably vertically may communicate with each other owing to the convergence angle. However, if the second guide wall is constructed in the aforesaid manner, substantial guiding can be performed by the second wall. The first guide wall is needed as a final guide that converges the respective tip ends of the needles on the dotting position.

The tip needle guide is formed of the first guide wall and the second guide wall as one body. Even if the through holes in the first guide wall communicate with each other, therefore, the brittleness of those parts is compensated, so that the guide is sturdy and highly durable.

This implies that the through holes 20 of the first guide wall 5*a* need not necessarily be made independent of one another. Thus, if an expensive material is selected so that each partition wall between the through holes 20 can be formed very thin, the through holes 20 of the first guide wall 5*a* can possibly be made independent of one another under a certain distance (x) between the first guide wall 5*a* and the second guide wall 5*b*. As long as the second guide wall 5*b* exists, however, it is more advisable to allow some of the through holes 20 of the first guide wall 5*a* to communicate with each other. This also applies to the case where the convergence angle of the needles is widened in order to reduce the longitudinal length of the needle bunch.

Since the tip needle guide is fixed to a head body, moreover, the second guide wall of the tip needle guide is also fixed. However, the aforesaid distance (y) is short, and the distance (x) between the walls are also short. Thus, there is hardly any problem of dislocation when the needles are set between the through holes of the first guide wall and the second guide wall of the tip needle guide as the needles are passed through the holes.

This invention may be applied to both a type such that the needles are used in a straight state and a type such that the tip end portions are bent toward the dotting position p by the intermediate guide.

BEST MODE FOR CARRYING OUT THE INVENTION

Figure 1A:
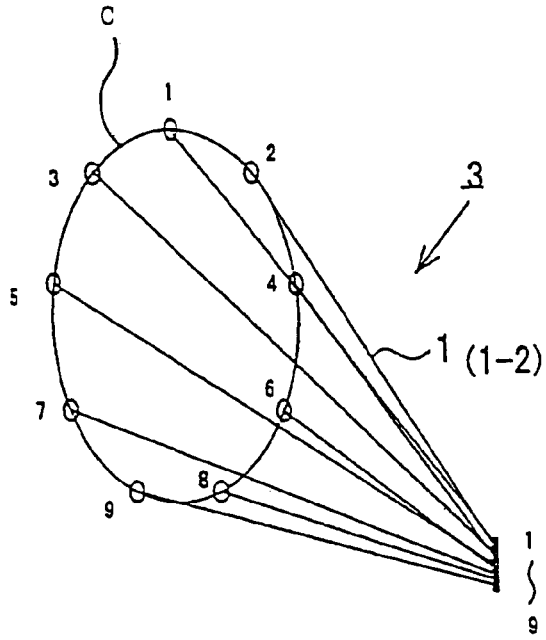
FIGS. 1A to 1D are views illustrating an outline of a print head in which a plurality of needles are bundled in the form of a cone.
Figure 1D:
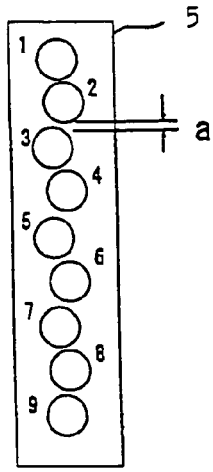
Figure 1B:
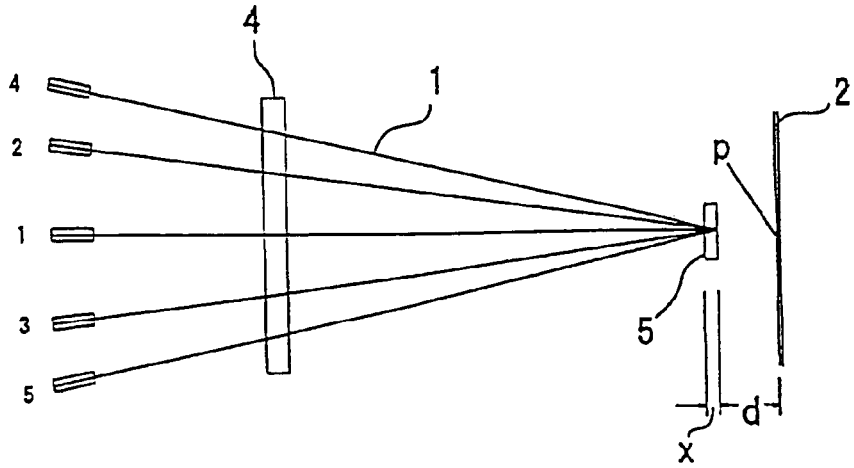
Figure 1C:
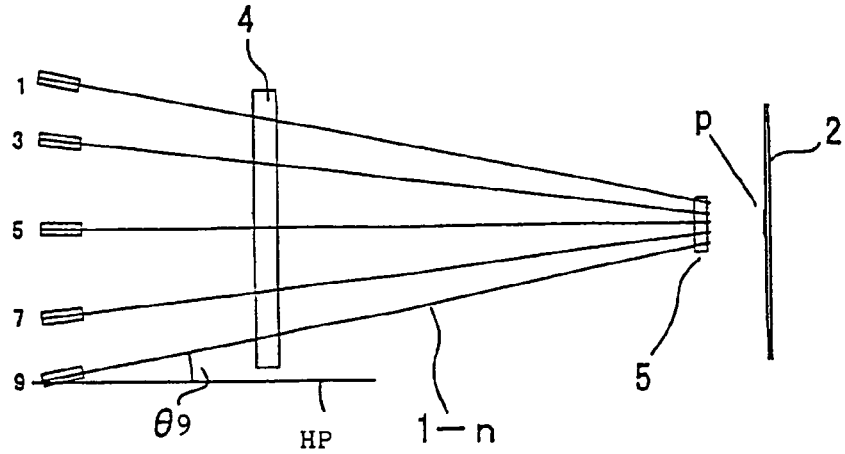
Figure 2A:
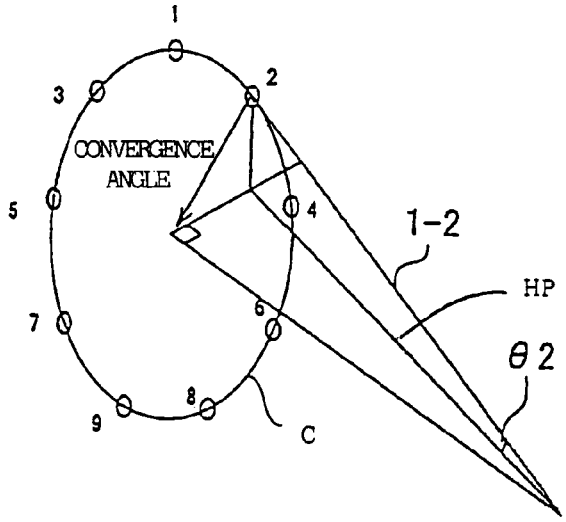
FIGS. 2A to 2C are views illustrating the relationship between the axial direction of the plurality of needles constituting the print head and needles holes of a needle guide.
Figure 2C:
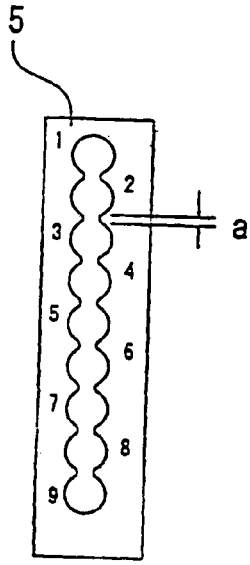
Figure 2B:
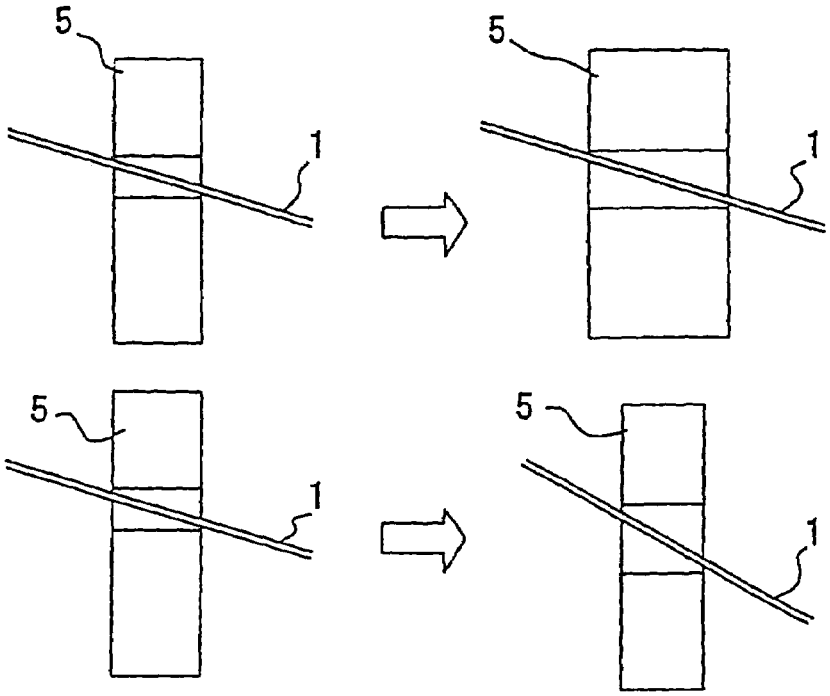
Figure 3:
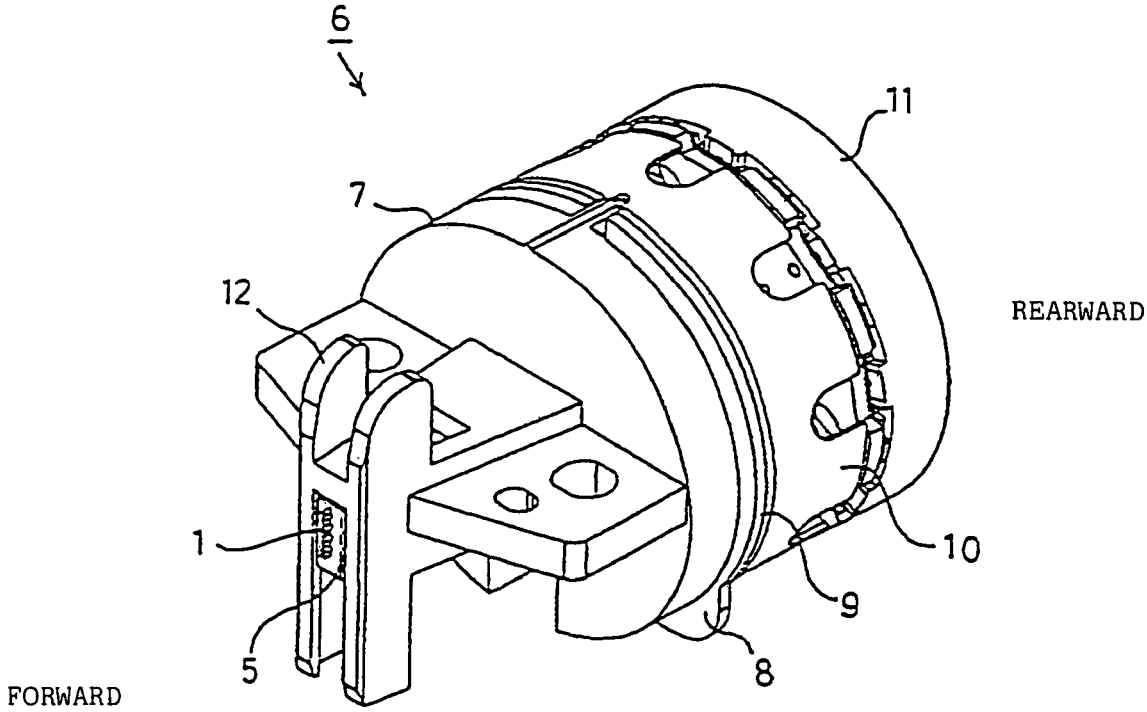
FIG. 3 is a perspective view showing an embodiment of a print head according to the present invention.

FIG. 3 shows a print head 6 according to an embodiment. A side that faces a paper and its opposite side are regarded as forward and rearward, respectively, and left- and right-hand sides and upper and lower sides are identified from the front side.

The print head 6 comprises a body case 7, circuit board 8, yoke 9, solenoid cover 10, and armature cover 11, which can be externally viewed in the order named from the front side.

Figure 4:
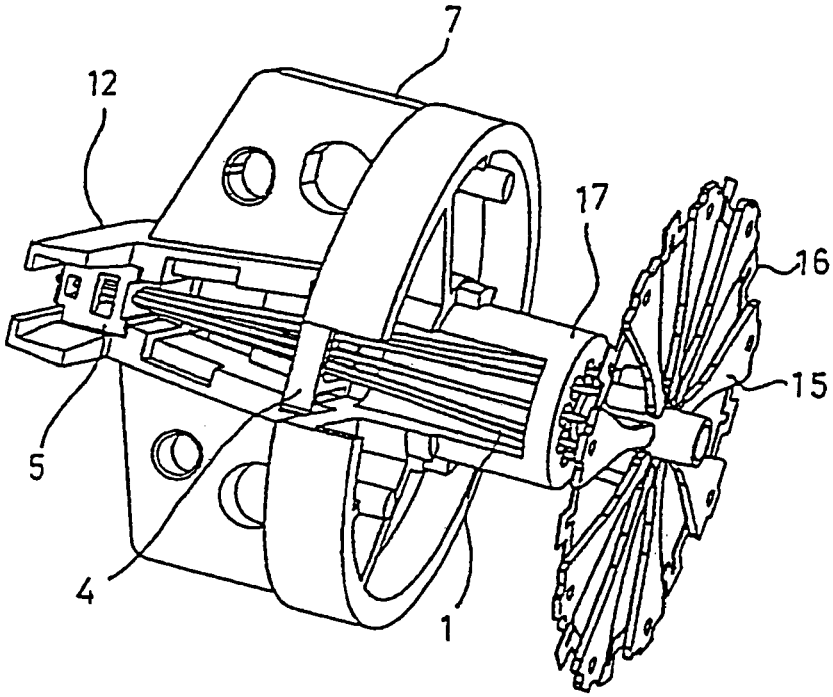
FIG. 4 is a view showing the inside of a body case of the print head shown in FIG. 3.

As shown in FIG. 4, nine needles 1 are arranged extending in the longitudinal direction in the body case 7 and guided by an intermediate needle guide 4 and a tip needle guide 5. The tip needle guide 5 and the respective tip ends of the nine needles 1 are seen through a nose portion 12 of the body case 7 of FIG. 3.

Figure 5:
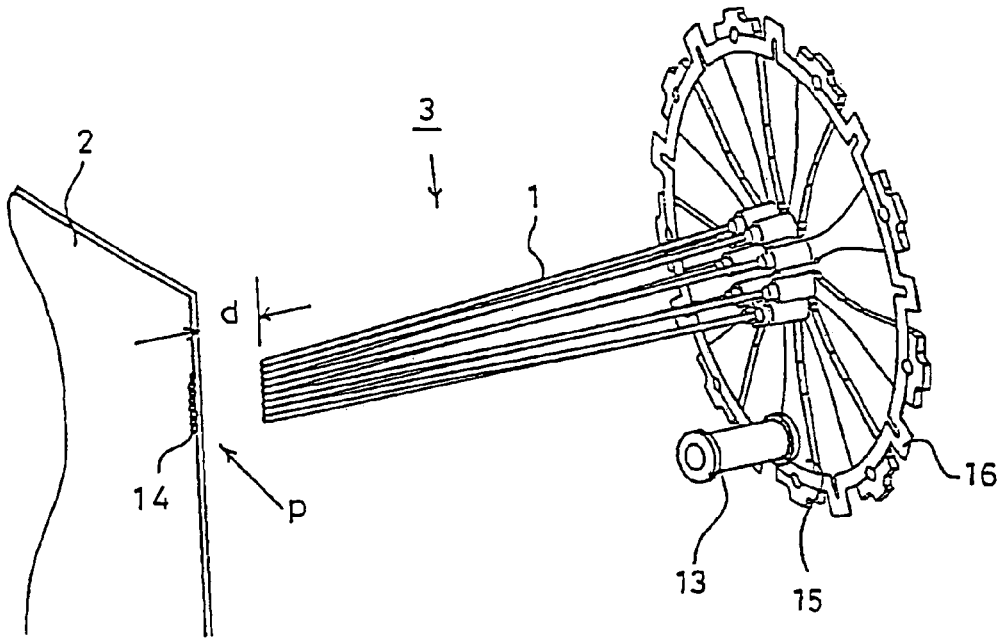
FIG. 5 is a perspective view illustrating the drive of the needles constituting the print head shown in FIG. 4.

The nine needles 1 (FIG. 5) are arranged on the circumference of a circle with their rear or proximal ends on a side of driving by solenoids 13 (one of which is shown) and with their front or tip ends vertically closely adjoining one another in a substantially straight line. More specifically, they are converged so as to be arranged in a straight line in a dotting position p where dots 14 are formed. As shown in FIG. 3, the tip ends of the needles slightly project from the tip needle guide 5. The distance between the front face of the tip needle guide 5 and the paper is d.

In this configuration that is formed of the bundle of nine needles, the tip end portions are arranged in a substantially straight line, so that the bundle is not perfectly conical. Since it resembles a cone, however, the bundle will be referred to as a cone-shaped needle bunch 3.

The respective proximal end portions of the needles 1 face the respective tip end portions of armatures 15 that are arranged opposite the yoke 9. When the armatures 15 are driven by the solenoids 13, the needles 1 are struck by the armatures 15 and project forward. Thereupon, their tip ends print the dots 14 with the aid of an ink ribbon. The armatures 15 are nine in total number, each corresponding to one of the needles 1, and are radially arranged so that their respective tip ends are directed from a peripheral edge of a ring-shaped support spring 16 toward the center of the ring of the spring 16.

A return spring (not shown) is fitted in the proximal end of each needle 1. When the solenoids 13 are de-energized so that the armatures 15 return to their respective neutral positions, the projected needles 1 are returned to an original position. The yoke 9, solenoids 13, armatures 15, etc. constitute a drive mechanism for the needles 1, and are held inside the solenoid cover 10 and the armature cover 11. Further, the proximal end side of the needles 1 is loosely guided by a proximal guide 17.

For convenience of description, numerals 1 to 9 are suffixed individually to the needles 1. The uppermost needle 1 at the tip end portion of the needle bunch 3 is denoted by 1-1 (which implies a needle No. 1), and the others by 1-2 to 1-9 in succession. Thereupon, on the proximal end side where the needles are arranged at regular intervals on a circumference C, the needles are alternately located on the circumference C in a manner such that the needle 1-1 is situated on the top of the circle as viewed from the front side, 1-2 on the right of it, 1-3 on the left, then 1-4 on the right again, and so forth. The needle 1-9 is at the bottom. Thus, each needle 1 has its own convergence angle θn (n is the needle number). In a plan view, the needle bunch 3 is in the form of a cone that has its vertex in the dotting position p. As viewed laterally, it has a form such that the tip portion of a conical configuration is cut with a plane that is perpendicular to the vertical direction.

Figure 6:
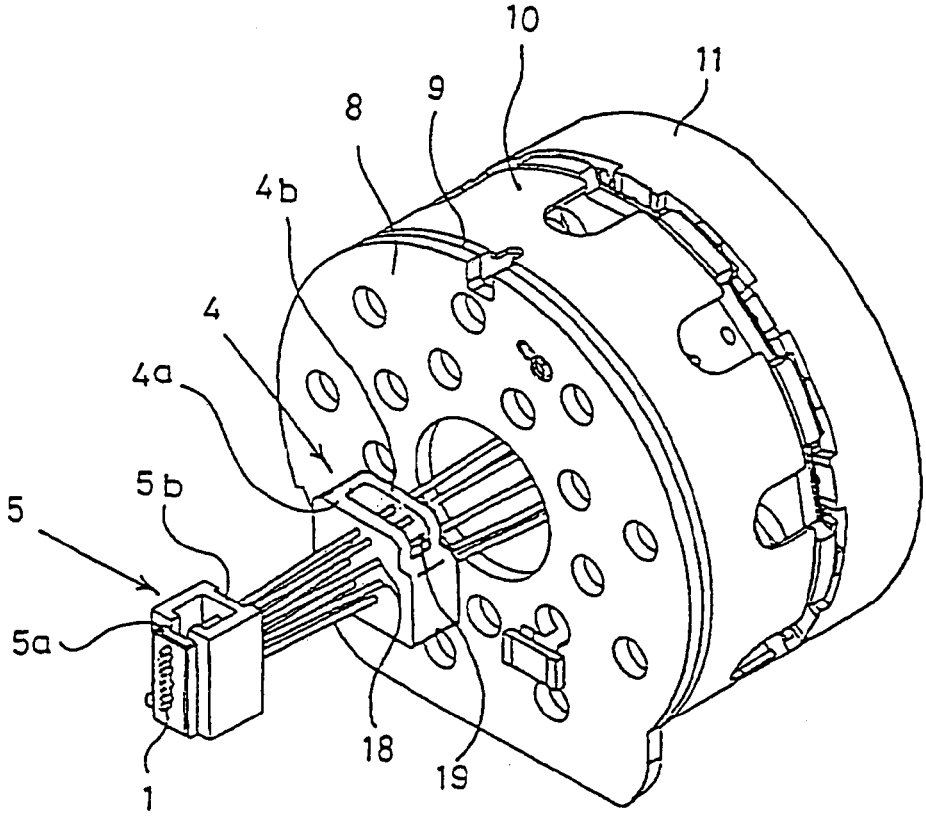
FIG. 6 is a view of the print head of FIG. 3 with its body case removed, showing configurations of an intermediate needle guide and a tip needle guide for guiding the needles.

The intermediate needle guide 4 is an integral block that has a first guide wall 4*a* and a second guide wall 4*b*, and the tip needle guide 5 is also an integral block that has a first guide wall 5*a* and a second guide wall 5*b* (FIG. 6). Any of the guide walls 4*a*, 4*b*, 5*a* and 5*b* has a surface that is perpendicular to the longitudinal direction of the needle bunch 3, and the first guide walls are situated on the tip end side (front side).

The intermediate needle guide 4 will be described first.

The first guide wall 4*a* on the front side and the second guide wall 4*b* on the rear side are located at a distance (x) from each other and formed with through holes 18 and 19, respectively, which are penetrated by the nine needles 1, individually. The holes 18 and 19 extend parallel to the longitudinal direction of the needle bunch 3. For each needle 1-n, a through hole 18*n* in the first guide wall 4*a* and a through hole 19*n* in the second guide wall 4*b* are formed with a shift amount (δn) in the convergence direction of the needle. The shift amount (δn) is determined by the aforesaid distance (x) and a convergence angle (θn) of the needle by using a simple trigonometric function, for example. The shift amount (δn) and the convergence direction vary for every needle 1 (value n).

A plurality of intermediate needle guides 4 may be arranged in some cases. Preferably, these intermediate needle guides 4 should be arranged so as to be slightly longitudinally movable with respect to the body case 7 so that the needle bunch 3, along with the intermediate needle guides 4 and the tip needle guide 5, can be automatically aligned when it is set in the body case 7.

Figure 7:
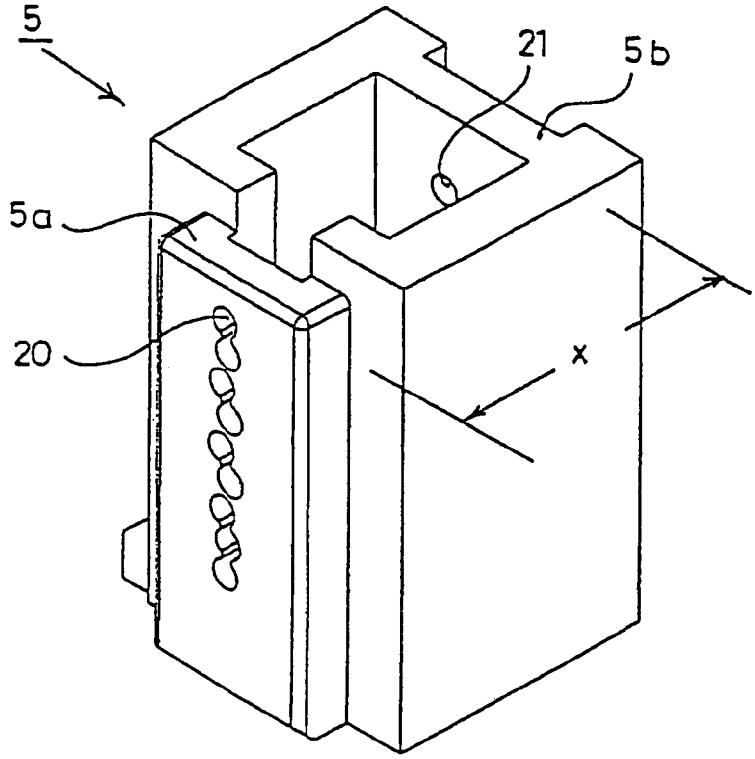
FIG. 7 is a front perspective view of the tip needle guide shown in FIG. 6.
Figure 8:
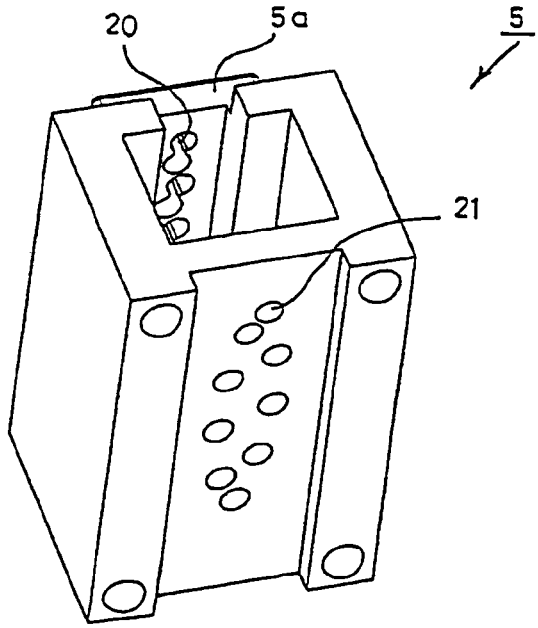
FIG. 8 is a rear perspective view of the tip needle guide shown in FIG. 6.

The following is a description of the tip needle guide 5 (FIGS. 7 and 8).

The tip needle guide 5 is provided with the first guide wall 5*a* and the second guide wall 5*b*, which are arranged longitudinally parallel to each other and at the distance (x) from each other, and is molded from nylon in the form of a short square integral pipe as a whole. Nine through holes 20 are formed in the front first guide wall 5*a*, and nine through holes 21 in the rear second guide wall 5*b*.

For each needle 1-n, a through hole 20*n* in the first guide wall 5*a* and a through hole 21*n* in the second guide wall 5*b* are arranged in like manner with respect to the shift amount (δn). Since the needles 1 are located close to one another in the tip needle guide 5, however, they require a special consideration.

More specifically, the needles 1 are situated vertically close to one another in the position of the first guide wall 5*a*. As shown in FIG. 7, therefore, Nos. 1 and 2, Nos. 3 and 4, Nos. 5 and 6, and Nos. 7, 8 and 9, out of the through holes 20 in the guide wall 5*a*, are formed inevitably communicating with one another. This is attributable to the properties of nylon as a material. If the width of a partition wall between any adjacent two of the through holes 20 is 40 μm or less, in the case of the nylon used, it is hard to form such a partition wall accurately between through holes, as a result, two through holes 20 are usually formed communicating with each other without any partition wall formed between them. Incidentally, gaps between Nos. 2 and 3 of the through holes 20, between Nos. 4 and 5, and between Nos. 6 and 7 are 55.6 μm, 69.3 μm, and 60.7 μm, respectively.

The position of the first guide wall 5*a* is settled for the design of the layout of a dot printer, and the clearance d between the first guide wall 5*a* and the paper 2 is also settled, so that some of the through holes 20 of the first guide wall 5*a* may inevitably communicate with each other. Further, the tendency of the through holes 20 to communicate with each other becomes more remarkable with the increase of the convergence angle θ of the needles 1.

Thus, the second guide wall 5*b* of the tip needle guide 5 is provided in a position such that the through holes 21 never communicate with each other, whereby the disadvantage of the inevitable communication between the through holes 20 in the first guide wall 5*a* can be compensated. Thus, lowering of the strength and guide functions that is attributable to the communication between the through holes 20 of the first guide wall 5*a* can be prevented by making each through hole 21 in the second guide wall 5*b* independent of another through hole 21. In order to curtail the longitudinal length of the print head 7, moreover, the distance (x) between the first guide wall 5*a* and the second guide wall 5*b* is minimized.

Thus, the distance (x) between the first guide wall 5*a* and the second guide wall 5*b* of the tip needle guide 5 is adjusted to a minimum selectable value such that the thickness of a partition wall between the vertically adjoining through holes 21 in the second guide wall 5*b* is not smaller than an allowable thickness (a), 40 μm in this embodiment, of a partition wall between adjoining through holes 21 in a guide wall of material (nylon, in this embodiment) from which the tip needle guide is made.

If the distance (x) exceeds the aforesaid minimum selectable value, it is apparent that through holes 21 can be made independent of each other. On the other hand, if the distance (x) equals to the aforesaid minimum selectable value, the size of a partition wall is very near to 40 μm as far as it can be formed between through holes 21. In this embodiment, the distance (x) is x=3 mm.

In examining a position in which the through holes 21 of the second guide wall 5*b* of the tip needle guide 5 can be molded independently of each other, consideration should be given to a distance (y) from the dotting position p to the second guide wall 5*b*. Since y is y=d+x and d is a constant, an examination of (y) is substantially equivalent to an examination of (x).

Further, the value of the distance (x) in the tip needle guide 5 is so small that the possibility of "rubbing" that is attributable to the alignment of the needles 1 between the first guide wall 5*a* and the second guide wall 5*b* is negligible. Therefore, the first guide wall 5*a* and the second guide wall 5*b* can be molded into an integral block without hindrance. Molding into the integral block rather improves the general structural strength and durability of the tip needle guide 5.

While one embodiment of the present invention has been described above, the material for the intermediate needle guide 4 and the tip needle guide 5 may be ceramic or metal in some cases. The needles 1 may be nine or more in number.

Constructed in this manner, the print head according to the present invention is improved in the durability of the needle guides, in particular, of the print head of the dot printer. Further, low-priced products can be fabricated by utilizing widespread materials such as synthetic resin. Furthermore, the convergence angle of the needles can be widened, and the print head can be miniaturized.

The invention claimed is:

1. A print head for selectively projecting a plurality of needles to perform printing, characterized in that the respective proximal ends of the plurality of needles on the drive side are arranged on the circumference of a circle, so that the needles constitute a cone-shaped needle bunch converged in a manner such that tip ends for forming dots are arranged straight in a dotting position, the needle bunch is kept in the cone-shaped configuration by a needle guide, the needle guide is composed of a first guide wall and a second guide wall arranged in the longitudinal direction of the needle bunch, the first guide wall being placed on the tip end side of the needle bunch and the second guide wall being spaced from the first guide wall by the distance (x), and the first guide wall and the second guide wall are walls perpendicular to the longitudinal direction of the needle bunch and are formed into an integral block, the guide walls having through holes penetrated parallel to the longitudinal direction of the needle bunch by the needles, the through holes of the first guide wall and the second guide wall for one needle (No. n) being shifted from each other in the convergence direction of the needles by a shift amount (δn) determined by the distance (x) and a convergence angle (θn) of the needle.

2. The print head according to claim 1, wherein the distance (x) between the first guide wall and the second guide wall of the tip needle guide at the tip end of the needle bunch in the print head is adjusted to a minimum selectable value as far as the thickness of a partition wall between the vertically adjoining through holes in the second guide wall is not smaller than the allowable thickness (a) of a partition wall between adjoining through holes in a guide wall of a material from which the tip needle guide is made.

3. The print head according to claim 1 or 2, wherein the first guide wall is situated on the tip end of a nose portion of a body case.

4. The print head according to claim 1 or 2, wherein some of the through holes of the first guide wall communicate with each other.

5. The print head according to claim 1 or 2, wherein at least two of the plurality of through holes in the first guide wall communicate with each other.

6. The print head according to claim 1 or 2, wherein the needle guide is formed of synthetic resin.

* * * * *